US008205372B2

(12) United States Patent
Anzeloni

(10) Patent No.: US 8,205,372 B2
(45) Date of Patent: Jun. 26, 2012

(54) SAFETY DEVICE FOR FIREARM AND REMOTE CONTROL SYSTEM OF ONE OR MORE FIRE-ARMS PROVIDED WITH SAID DEVICE

(75) Inventor: Massimiliano Anzeloni, Castiglione delle Stiviere (IT)

(73) Assignee: Famiglia Anzeloni Srl, Castiglione delle Stiviere MN (IT)

( * ) Notice: Subject to any disclaimer, the term of this patent is extended or adjusted under 35 U.S.C. 154(b) by 423 days.

(21) Appl. No.: 12/281,833

(22) PCT Filed: Feb. 26, 2007

(86) PCT No.: PCT/IT2007/000137

§ 371 (c)(1),
(2), (4) Date: Feb. 4, 2009

(87) PCT Pub. No.: WO2007/102181

PCT Pub. Date: Sep. 13, 2007

(65) Prior Publication Data

US 2009/0223104 A1 Sep. 10, 2009

(30) Foreign Application Priority Data

Mar. 8, 2006 (IT) ..... RM2006A0119

(51) Int. Cl.
*F41A 17/06* (2006.01)

(52) U.S. Cl. ..... 42/70.01

(58) Field of Classification Search ..... 42/70.01, 42/70.11

See application file for complete search history.

(56) References Cited

U.S. PATENT DOCUMENTS

| | | | | |
|---|---|---|---|---|
| 3,682,283 | A | 8/1972 | Sato | |
| 3,767,985 | A | 10/1973 | King | |
| 3,939,679 | A * | 2/1976 | Barker et al. | 70/277 |
| 4,488,370 | A | 12/1984 | Lemelson | |
| 5,168,114 | A * | 12/1992 | Enget | 42/70.01 |
| 5,459,957 | A * | 10/1995 | Winer | 42/70.11 |
| 5,546,690 | A * | 8/1996 | Ciluffo | 42/70.11 |
| 5,603,180 | A * | 2/1997 | Houze | 42/70.11 |
| 5,636,464 | A * | 6/1997 | Ciluffo | 42/70.11 |
| 5,675,925 | A * | 10/1997 | Wurger | 42/70.11 |
| 5,704,153 | A * | 1/1998 | Kaminski et al. | 42/70.11 |
| 6,237,271 | B1 * | 5/2001 | Kaminski | 42/70.06 |
| 6,363,647 | B2 * | 4/2002 | Kaminski | 42/70.11 |

(Continued)

FOREIGN PATENT DOCUMENTS

GB 2 340 589 A 2/2000

(Continued)

*Primary Examiner* — Bret Hayes
*Assistant Examiner* — Reginald Tillman, Jr.
(74) *Attorney, Agent, or Firm* — Young & Thompson

(57) ABSTRACT

A safety device (1) for fire-arms (11), includes actuator elements (10; 10'; 19, 20, 21, 21', 22), suitable to engage with mechanical parts of the fire-arm (11) so as to prevent and/or permit its operation; and a control unit (2), operatively connected with the actuator elements (10; 10'; 19, 20, 21, 21', 22), the control unit (2) including transceiving elements (3), cooperating with certification outer members brought by an authorized user (U) for exchanging signals with the same for codified remote control of the actuator elements (10; 10'; 19, 20, 21, 21', 22). A remote control system for one or more firearms provided with the safety device is also disclosed.

30 Claims, 6 Drawing Sheets

U.S. PATENT DOCUMENTS

| | | | | |
|---|---|---|---|---|
| 6,412,207 | B1 | 7/2002 | Crye et al. | |
| 6,415,542 | B1 * | 7/2002 | Bates et al. | 42/70.11 |
| 6,481,140 | B1 * | 11/2002 | Marshall | 42/70.11 |
| 6,563,940 | B2 * | 5/2003 | Recce | 382/120 |
| 7,600,339 | B2 * | 10/2009 | Schumacher et al. | 42/70.01 |
| 7,703,229 | B2 * | 4/2010 | Parhofer et al. | 42/70.01 |
| 2001/0032405 | A1 | 10/2001 | Kaminski | |
| 2004/0244253 | A1 * | 12/2004 | Glock | 42/70.11 |
| 2006/0208857 | A1 * | 9/2006 | Wong | 340/5.82 |
| 2007/0074438 | A1 * | 4/2007 | Parhofer et al. | 42/70.01 |
| 2009/0064557 | A1 * | 3/2009 | Hughes et al. | 42/70.01 |

FOREIGN PATENT DOCUMENTS

| | | | |
|---|---|---|---|
| WO | 97/26471 | A | 7/1997 |

* cited by examiner

SECTION A-A

B-B

C-C

C-C

B-B

SAFETY DEVICE FOR FIREARM AND REMOTE CONTROL SYSTEM OF ONE OR MORE FIRE-ARMS PROVIDED WITH SAID DEVICE

The present invention relates to a safety device for firearm and remote control system of one or more firearms provided with said device.

More specifically the invention relates to a device of the above kind, studied and realised particularly to be applied on fire-arms, permitting the use of the same only to authorised users.

BACKGROUND OF THE INVENTION

As it is well known, at present, both for legislative reasons and for objective needings, it is always more diffused purchase of firearms by civil users. Therefore, often a firearm is available within private apartments for safety reasons.

Anyway, it is possible having at disposal a firearm in an apartment also for sport or for hunting.

More diffused firearms present within said civil apartments are guns and rifles.

Main problem is that said firearms can be also accidentally used by under age users. This is clearly very dangerous for their safety.

Different solutions already exist to solve this problem. Among the more diffused, it can be mentioned the use of metallic wire closed by a padlock. Said metallic wire is inserted a channel passing through mechanical parts of said gun, so as to prevent its operation. Padlock prevents removal of said padlock.

Another solution provides the use of plugs to be fixed to the firearm cartridge chamber. Said plugs are fixed by suitable fixing means, and prevent firearm shots start accidentally.

Finally, it is always possible disassembling said firearms in order to prevent their use by said users.

Main problem of all the above solutions is that the firearm cannot be always available for use. In other words, in case of need or danger, to be able to use the firearm it is necessary removing locking devices or assembling it. These activities require time, and in case of need said firearm is not ready to be used.

Another serious danger is due to the fact that said not skilled users can use firearms. For example, in case a thief enters within a property and in case of danger or scuffle, firearm can be in the hands of the same thief. In this situation, the thief, being threaded, could use the firearm against the owner of the same or against his/her parents.

SUMMARY OF THE INVENTION

In view of the above, it is object of the present invention that of making it available a device that can be applied to all firearms, permitting the use of the same only by authorised users.

Another object of the present invention is that said device can be installed in existing guns directly or during their manufacturing.

It is therefore specific object of the present invention a safety device for fire-arms, characterised in that if comprises actuator means, suitable to engage with mechanical parts of said fire-arm so as to prevent and/or permit its operation; and a control unit, operatively connected with said actuator means, said control unit comprising transceiving means, cooperating with certification outer means brought by an authorised user for exchanging signals with the same for codified remote control of said actuator means.

Always according to the invention, said transceiving means comprise electromagnetic transceiving means and said certification means cooperating with the same comprise a transponder, said transponder being brought by the authorised user.

Still according to the invention, said electromagnetic transceiving means can comprise a turn and a modulation/demodulation radio frequency unit.

Furthermore, according to the invention, said transponder can be a passive transponder.

Advantageously, according to the invention, said transponder can comprise an integrated circuit, storing an identification code.

Always according to the invention, said transponder can be provided in a bracelet or in a ring put on by said authorised user or placed under the skin of said authorised user.

Still according to the invention, said reception means comprise a voice recognition device, said voice recognition device activating said actuator means by a voice control and deactivating the same by a second voice control and/or after a set time period.

Advantageously according to the invention, said control unit can comprise a processing unit, connected to a power circuit for piloting of said actuator means.

Furthermore, according to the invention, said processing unit can comprise a micro controller, preferably a programmable micro controller.

Still according to the invention, said actuator means can comprise an electric motor with a shaft, operatively coupled with said control unit; a body, sliding within said arm, said body engaging with mechanical parts of said fire-arm; and means for transforming the motion, coupled with said motor and said body, transforming the rotatory motion of said motor into a translation motion of said body; activation of said motor permitting a translatory motion of said body, permitting to said body to engage or disengage from said mechanical parts of said fire-arm, preventing and/or permitting its operation.

Always according to the invention, said mechanical parts can be the parts comprising kinematic motion between trigger and percussion member of said fire-arm and comprise a lever transmitting the motion, pivoted on a trigger of said fire-arm and having an offset, said body engaging by its head in said offset of said lever transmitting the motion.

Advantageously, according to the invention, said means for transformation of the motion can comprise a worm screw, keyed on said shaft; and a threaded channel, obtained in said body and that can engage with said worm screw, comprising a first and a second half-worm screws housed within a cavity obtained within said body, said first and second half-worm screws being adjacent each other and a threaded channel being realised between them, within which said worm screw is inserted; and resilient means, such as a spring, between the inner wall of said body and said second half-worm screw, suitable to permit compensation of possible tolerances and a safe coupling of said worm screw within said threaded channel realised between said first and second half-worm screws.

Furthermore, said motion transformation means can comprise a further body keyed on said shaft, provided with a peripheral helicoidal groove, and a pin projecting with respect to the inner surface of said body, and that can engage with said helicoidal groove of said further body.

Preferably, according to the invention, said actuator means can be housed in the part under the firearm trigger so as stresses on the trigger are not transmitted to the movable parts and to cage of said motor.

Always according to the invention, said actuator means can comprise an electromagnetic lock bolt, said electromagnetic lock bolt being comprised of a lock bolt and of an inductor.

Still according to the invention, said lock bolt can engage within a cavity obtained on the trigger of said firearm.

Advantageously according to the invention said device can comprise supply means such as lithium battery or high efficiency cells, and said battery can be electrically connected with said control unit by a switch, said switch closing when said firearm is grasped.

Preferably, according to the invention, said device can comprise auxiliary supply means.

Still according to the invention, said supply means can comprise a holster provided with a further battery that can be connected with said battery by electric contacts in order to recharge the same when said firearm is placed within said holster.

It is further object of the present invention a remote control system for one or more firearms comprising each one a safety device, said system comprising one or more local transceiving unit, each one provided on said one or more firearms and connected with the corresponding safety device for its operation; and a control apparatus comprising first transceiving means suitable to interface with said local transceiving unit, said control apparatus being suitable to clearly inhibit or enabling operation of each firearm by said local transceiving unit and said safety devices of each firearm.

Always according to the invention, said control apparatus can comprise second transceiving means, suitable to interface with a data transmission network; and a directional centre that can be connected with said control apparatus said directional centre being suitable to inhibit or to enable operation of each firearm by transmission of suitable controls that are sent to said control apparatus.

Still according to the invention, said network can be GPRS and/or UMTS network.

Furthermore, according to the invention, said one or more local transceiving means can be connected with said supply means of said safety device of each firearm, and can inhibit their operation.

Preferably, according to the invention, said local transceiving unit and said first transceiving means of said control apparatus can use the blue tooth protocol.

Always according to the invention, connection between each local transceiving unit and said control apparatus can be protected.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE PREFERRED EMBODIMENTS

Figure 1:
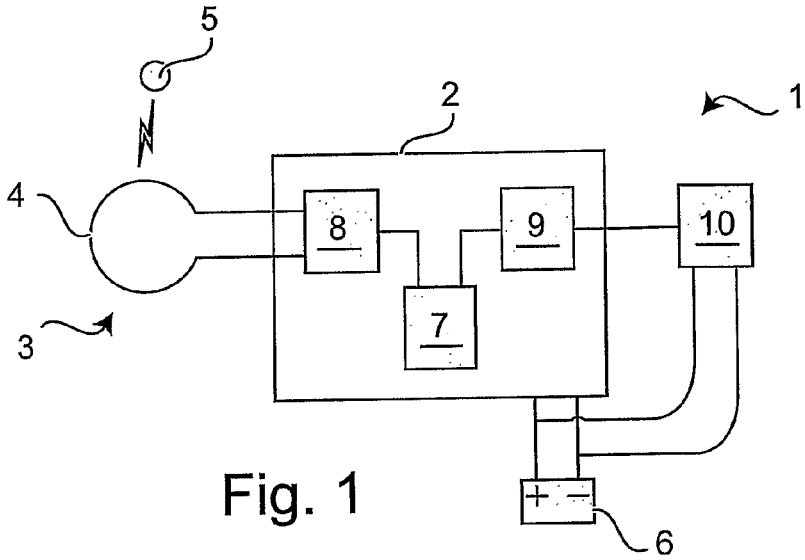
FIG. 1 is a block diagram of the safety device for firearms according to the present invention.

Making reference to FIG. 1, it is possible observing a block diagram of safety device 1 for firearms according to the invention.

Said device 1 mainly comprises a control unit 2, electrically connected with transceiving means 3, a battery 6 supplying said control unit 2 and actuator means 10.

In the embodiment described, said transceiving means 3 comprising a turn 4, cooperating with a transponder 5. Said control unit 2 and said transponder 5 can interact each other when the latter is close to the turn 4, receiving from the same turn a signal arriving from said transponder 5, as it will be better explained in the following.

Battery 6 can be of different kind. In this case, it is used an ultra flat battery, so as to save space and to make the whole device 1 light. This permits placing said device 1 also in very small firearms.

Said control unit 2 provides inside mainly three functional blocks: a processing unit 7, electrically connected with a radio frequency unit 8 and to a power unit 9.

Said processing unit is comprised, in the present embodiment, of a programmable micro controller.

Radio frequency unit 8 can be of different kind. Particularly, it can be of the active or passive kind. In the first case, quartz can be provided, eventually connected with a passive electric main. Instead, in the second case, an integrated oscillator can be eventually present.

Finally, device 1 comprises actuator means 10, comprised, in the embodiment shown in FIG. 1, of an electromagnetic lock bolt 10' installed inside the firearm, suitable to engage with mechanic elements of the latter. In other words, firearm cannot normally operate, since said electromagnetic lock bolt 10' inhibits its operation.

Said electromagnetic lock bolt 10' is substantially comprised of a lock bolt, the movement of which is controlled by an inductor.

Operation of the safety device 1 according to the invention will be better explained in the following. Radio frequency unit 8 generates a signal, irradiated in the space surrounding said device 1 by said turn 4, in this case acting as an antenna. Said radio frequency unit 8 is comprised in such a way to be in resonance following to the approaching of transponder 5.

Said transponder 5 is mainly comprised of a receiving antenna connected with a resonance circuit, which is connected with an integrated circuit.

Said transponder 5 can be of the active or passive kind. Usually, it is suitable using passive kind transponder 5, not being necessary an autonomous supply to operate. In other words, said transponder 5 can supply by itself by power irradiated by the same turn 4.

Signal irradiated from said turn 4 is suitably codified and modulated. In this way, not every transponder of the same kind can activate the control unit 2. In fact, transponder integrated circuit 5 is suitably programmed to recognize the above codified and modulated signal.

When transponder 5 is close to said turn 4, it receives signal containing a recognising code, modulated in the suitable carrier frequency. Said radio frequency unit 8 demodulates the signal, sending it to said processing unit 7. Once recognized said code, said processing unit 7 pilots power unit 9, inducing a piloting current in inductance in electromagnetic lock bolt 10'.

Thus, lock bolt 10' is retracted following the action of the magnetic field on said inductance. Said lock bolt 10' disengage from the firearm mechanical parts, permitting its use.

In case transponder 5 is moved away from said turn 4, radio frequency unit 8 stops resonating and processing unit 7 disconnects power unit piloting. Lock bolt 10' is released, engaging again with the firearm mechanical parts.

Figure 2:
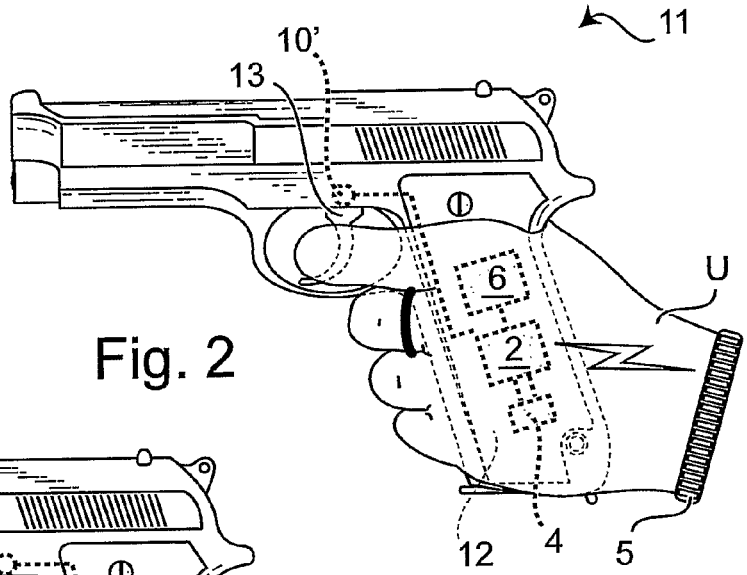
FIG. 2 is a transparency lateral view of a gun grasped by a user, with the safety device according to FIG. 1.
Figure 3:
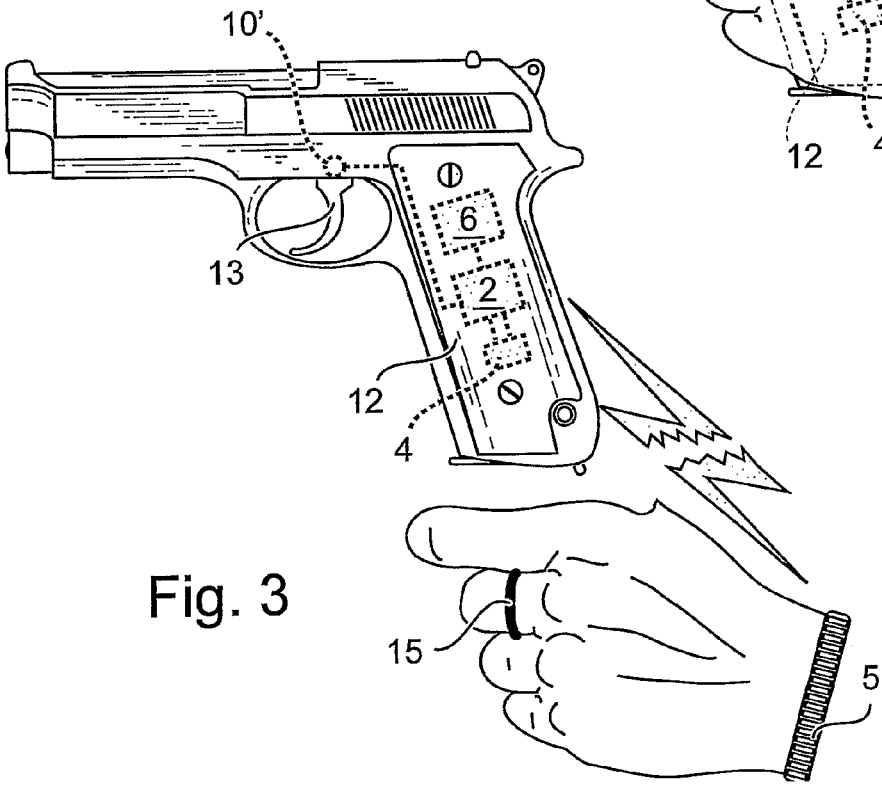
FIG. 3 is a transparency lateral view of a gun according to FIG. 2.

Making now reference to FIGS. 2 and 3, it is possible observing implementation of said safety device 1 in a firearm 11.

It is noted that said safety device 1 is provided within the handle 12 of said gun 11.

In the embodiment represented in the figures, transponder 5 is placed within the bracelet put on by the user. When gun 11 is grasped by said user U, transponder 5 is at a distance sufficient to permit activation of said electromagnetic lock bolt 10'. In this way, gun 11 can be used.

From FIG. 3 it can be observed that when authorised user U leaves handle 12 of said gun 11, electromagnetic connection between transponder 5 and turn 4 disconnects and consequently gun 11 can no more be used.

Figure 4:
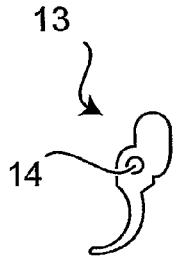
FIG. 4 shows the trigger of gun of FIG. 2.

An embodiment is shown in FIG. 4 wherein said lock bolt engages with mechanical parts of said gun 11. In this case, a cavity 14 or channel is realised in said trigger.

When operation of said gun 11 is inhibited, said lock bolt 10' is introduced within said cavity 14, blocking movement of said trigger 13. on the contrary, due to the approaching of said transponder 5 to said turn 4, said lock bolt 10' comes out from said cavity 14, freeing said trigger 13, as it is clear for those skilled in the art.

Said device 1 can be also provided with interface means, such as small LEDs (micro-LEDs) (not shown in the figures) indicating the firearm operative mode.

For example, it can be present a red LED, indicating that the firearm cannot operate, and a green LED indicating that the firearm is activated.

In a preferred embodiment, circuit of device 1 (component surface) is of about 20×30 mm and with a maximum thickness of 3 mm. A red micro-LED is placed on a side of the circuit. Said micro LED is placed so as to be on the same plane, projecting of about 3 mm from the right side of the printed base, to come out from the plastic body of the firearm 11, so as to be visible when the firearm is grasped for firing both by a right-hand shooter and a left-hand shooter.

A double plug outlet is provided on the opposite side of the circuit of said device 1, laying on the plane of the printed board, for connection with the mechanical parts suitable to transmit motion to the trigger block or to the percussion member.

Battery 6 housings, or otherwise supply plugs (not included in the physical dimensions of said printed board) are provided on the lower side, along the same plane.

Furthermore, in order to obtain a better versatility, firearm 11, particularly in case it is a short and semiautomatic firearm, can be provided with a professional holster-feeder. Charging of battery 6 is obtained by induction and is automatically and continuously carried out every time said firearm 11 is put inside the holster, wherein a battery charging pack is provided, which is rechargeable as well.

To activate transponder 5, minimum distance from said transceiving means (activation field) is of 60 mm, preferably 100 mm.

When device 1 is switched on, even simply for introduction of battery 6, after a short check, during which LED emits a set acoustic-visual sequence, permanent activation of device 1 will occur in correspondence of ending of acoustic signal and switching off of a single red LED.

Preferably, in order to obtain higher operation reliability, it is possible providing an auxiliary battery (not shown in the figure), activated in case main battery is exhausted.

Particularly, after this event, it is suitable including a possible further LED in said device 1, in order to indicate that said battery 6 is exhausted and must be replaced.

During normal operative conditions, with battery 6 at full charge, red LED will be always switched off. When transponder 5 enters within the activation field of said transceiving means 3, red LD will switch on, remaining switched on while transponder 5 remains within the same field.

In case the primary battery 6 is almost to discharge, red LED will quickly lightens while transponder 5 is within the transponder 5 field. When the system automatically passes to the secondary supply, red LED will lightens more slowly while transponder 5 is within field. When the auxiliary battery is completely discharged, red LED will not switch on, thus indicating that safety device 1 is out of order.

Said supply system can last in stand-by mode for a long time, preferably 1 year, and in a continuous activation-deactivation function of when the firearm is grasped up to 7 days or for 1000 switching on/off cycles (firearm grasped 3 times per day for 1 year).

Said batteries (both main battery 6 and the auxiliary one), besides the embodiment of FIG. 1, particularly lithium batteries, can be also comprised of last generation, very slim and cheap, high efficiency cells.

Said device 1 can be realised on a printed circuit or completely integrated within a chip. In the second case, it is well evident high level of miniaturisation that can be obtained.

As already said, transponder shown in FIGS. 2 and 3 is provided in a bracelet put on said user U. It is obviously possible thinking other positions, such as in a ring, indicated in the above figures by reference number 15.

In a further embodiment, it is possible placing said transponder 5 under the skin.

Finally, in order to make the use of said firearms much safer, it is possible improving the positioning of said device 1. Particularly, it is possible placing a kind of switch on the handle of said gun or firearm, that, when is closed following the grasping of firearm by said user U, activates supply of said device 1.

Thus, it is not sufficient the approaching of said transponder 5 to said turn 4 for activating said electromagnetic lock bolt 10' or other actuator means. It will be also necessary grasping said gun to supply said device 1 by battery 6.

In further embodiments of the present invention, it is possible taking into consideration the use of different kind of transceiving means 3. For example, it is possible replacing said transponder 5, said turn 4 and said radio frequency unit 8 with a suitably trainable vocal recognition unit. In this way, only users recognised by said vocal recognition unit will be allowed to use the firearm.

Obviously, it is possible applying any other kind of recognition device or apparatus for realising the invention.

Figure 5:
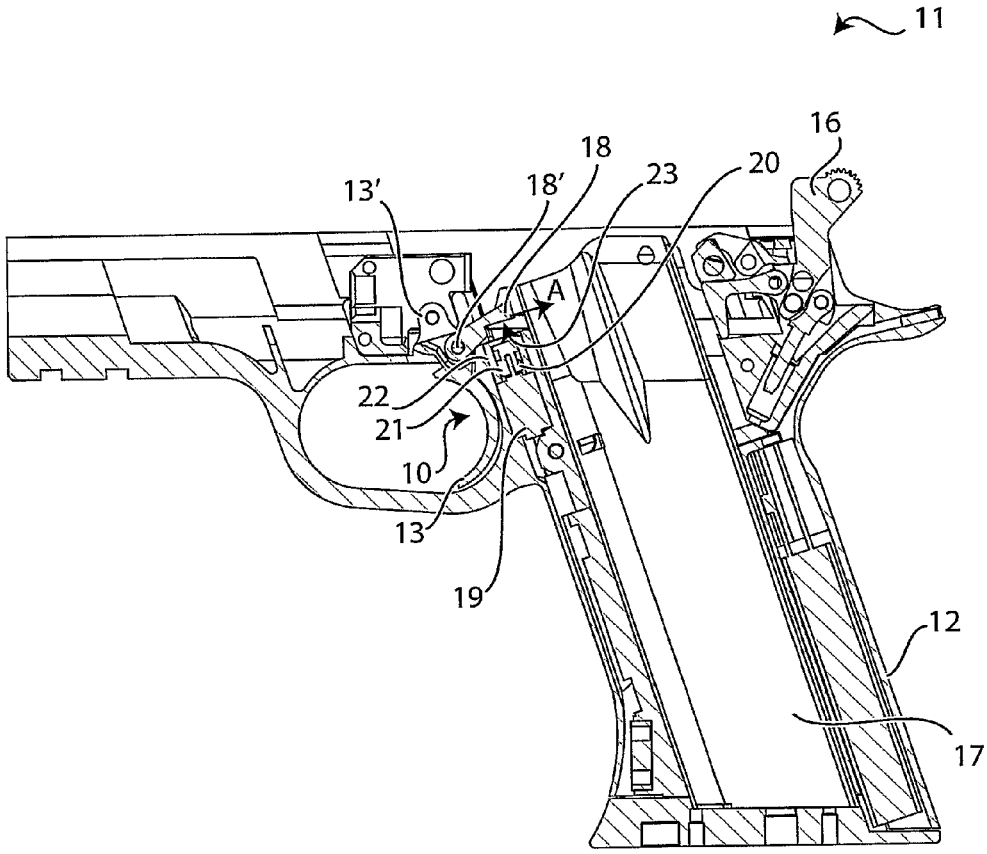
FIG. 5 is a longitudinal section of a gun with a preferred embodiment of actuator means of device according to the invention.
Figure 6:
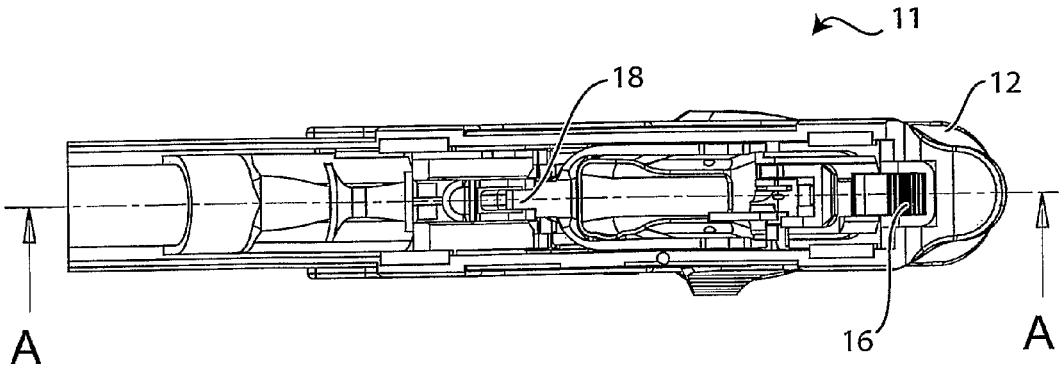
FIG. 6 is a plan section of the gun according to the invention.

FIGS. 5 and 6 respectively show a longitudinal section view with respect to an A-A plane and a plan view of a firearm 11, wherein a preferred embodiment of actuator means 10 according to the present invention is installed and the assembly in which said actuator means 10 interact with the firearm 11 mechanism. Furthermore, FIGS. 5*a*-5*d* show a first embodiment of actuator means 10 in the different operation positions.

Firearm 11 comprises a percussion member 16, or cane, suitable to hit the projectile arriving from a loader 17, inserted within handle 12) in order to permit switching on of propellant charge.

Said percussion member 16 can be operated by a suitable mechanism, connected by a motion transfer lever 18 pivoted on trigger 13' pin 18' which is pivoted on the firearm by pin 13'.

When the trigger 12 is pushed up to the end, lever 18 moves according to direction A, thus freeing percussion member 16, suitably preloaded, making the shot firing.

In an embodiment, said actuator means 10 comprise an electric engine 19, with a shaft 20 keyed on a worm screw 21, threading of which is engaged by a mating thread of a threaded channel of a body 22, said motor 19 is housed within the bottom part of the trigger 13 of said firearm 11 so that stresses applied on the trigger 13 are not transmitted to the movable parts and to the cage of the same motor 19.

Furthermore, said lever 18 has at the bottom an offset 23 in which can be engaged the upper part or head 22' of the body 22.

Operation of the above assembly is described in the following, with reference to FIGS. 7 and 8.

Figure 7:
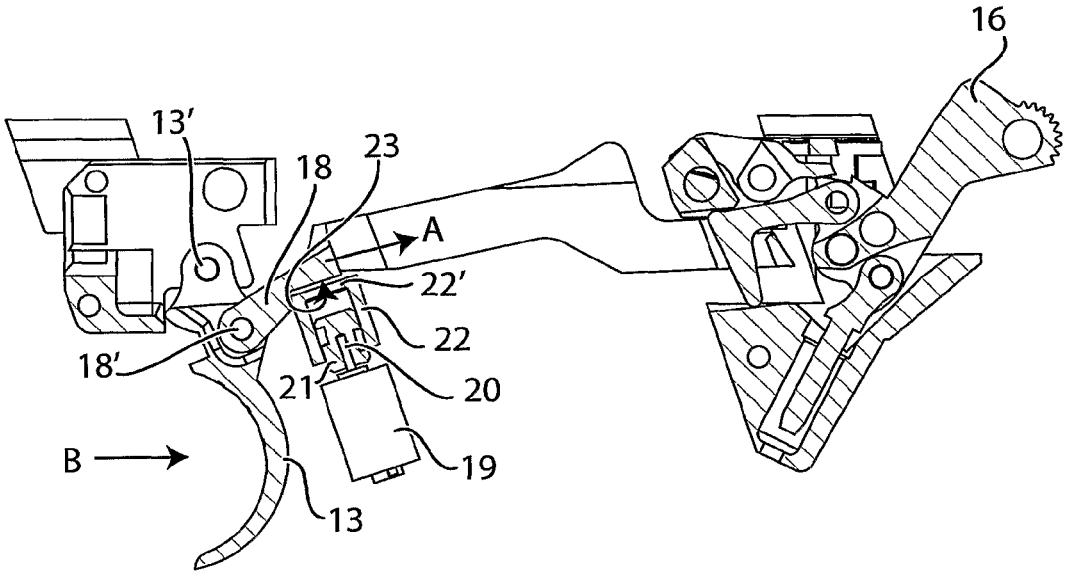
FIG. 7 is a longitudinal view of the mechanical transmission system between a trigger and the percussion member of a firearm and interaction with the same of the actuator means of device according to FIG. 5 in a locked position.

In fact, making first reference to FIG. 7, it is possible observing in detail said actuator means 10 blocking the firearm 11.

Particularly, it can be noted that head 22' of the body 22 is introduced within the offset 23, obtained in said motion transfer lever 18. In this configuration, pulling the trigger according to direction B, said motion transfer lever 18 is constrained by said body 22 and cannot transfer the motion according to direction A, thus preventing operation of the firearm, since the percussion member 16 is constrained.

Figure 8:
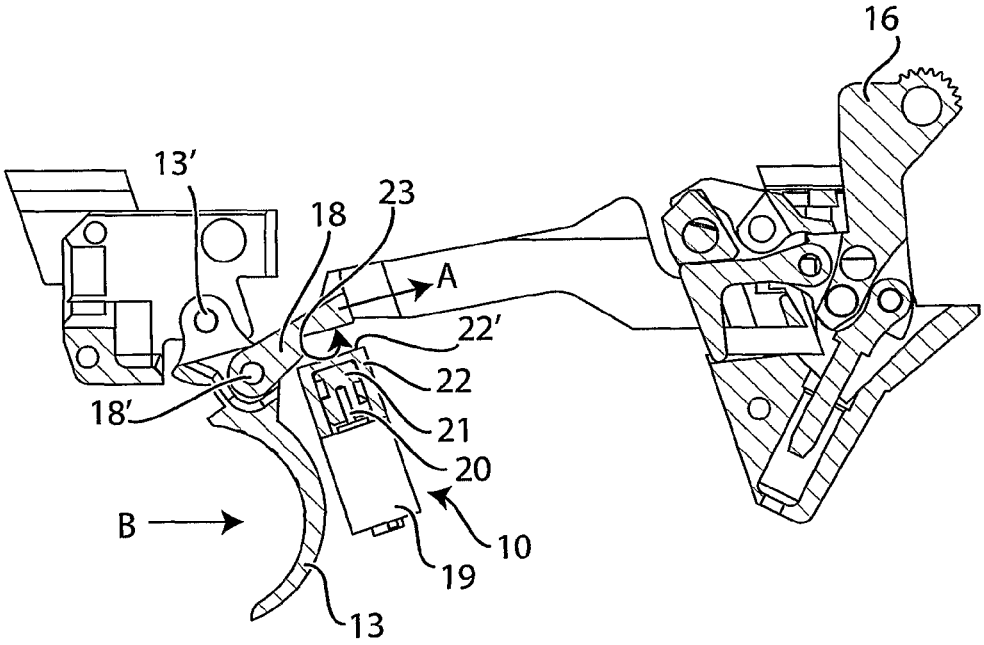
FIG. 8 shows a longitudinal view of the mechanical transmission system between a trigger and the percussion member of a firearm and interaction with the same of the actuator means of device according to FIG. 5 in a release position.
Figure 9:
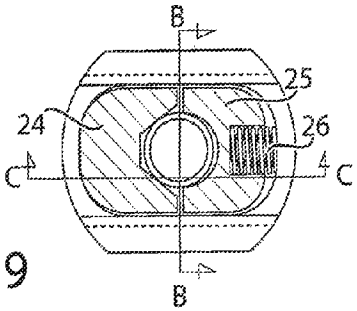
FIG. 9 is a partially sectioned plan view of actuator means according to FIG. 5.
Figure 11A:
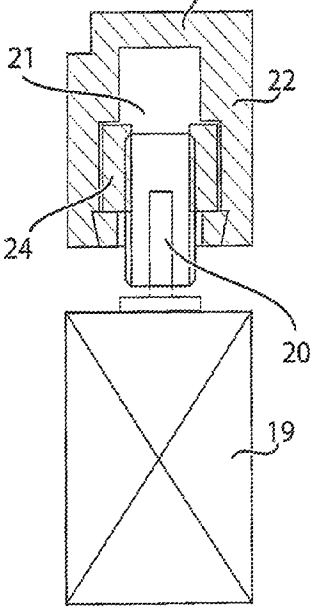
FIG. 11*a* shows a longitudinal section view of actuator means in an active position taken along plane B-B of FIG. 9.
Figure 11B:
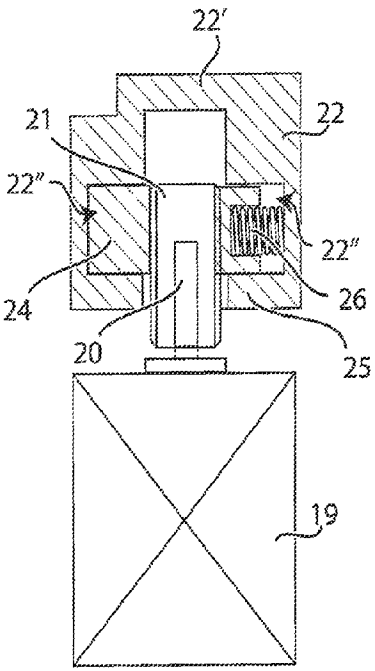
FIG. 11*b* shows a longitudinal section view of actuator means in an active position taken along plane C-C of FIG. 9.
Figure 10B:
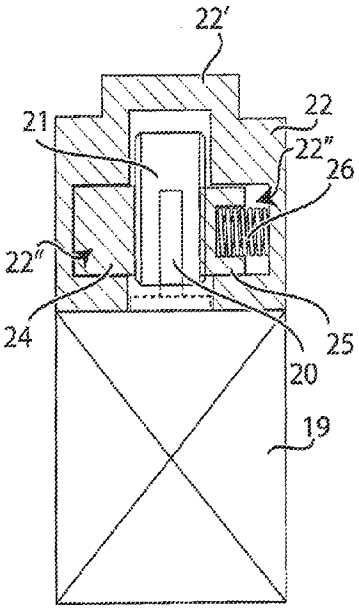
FIG. 10*b* shows a longitudinal section view of actuator means in a rest position taken along plane C-C of FIG. 9.
Figure 10A:
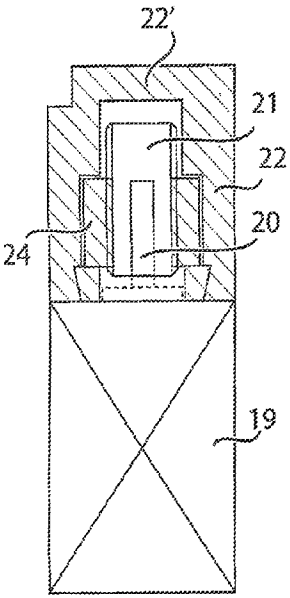
FIG. 10*a* shows a longitudinal section view of actuator means in a rest position taken along plane B-B of FIG. 9.

FIG. 8 instead shows actuator means 10 in a firearm release firearm 11.

Due to the control arriving from the power unit 9, which is controlled by the processing unit 7, motor 19 (obviously connected with said power unit 9) is activated, making its shaft 20 rotating and thus rotating worm screw 21 coupled with the same. Rotation of said worm screw 21 displaces body 22, disengaging the same from motion transfer lever 18 offset 23.

Now, pressing trigger 13 up to the end according to direction B, motion transfer lever 18 moves according to direction A, thus permitting activation of percussion member 16, suitably preloaded, to make the shot exiting.

FIGS. 9, 10*a*, 10*b*, 11*a* and 11*b* show a second embodiment of said actuator means and particularly the coupling between said worm screw 21 and said body 22.

Observing the above figures, it is noted that motor 19 shaft 20 is keyed on worm screw 21, and said screw is coupled with thread of a worm comprised of a first and of a second hemi-worms 24 and 25, adjacent to a seat 22" within the body 22.

A compensation spring 26 is provided between said second hemi-worm 25 and the inner surface of said body 22 seat 22", suitable to maintain an optimum coupling between thread of said worm screw 21 and said threaded channel comprised of said first and second hemi-worms 24 and 25, e.g. compensating thermal dilatation.

Rotation upward of said worm screw 21, i.e. in the position blocking firearm 11 (please compare FIGS. 10*a*-11*a* and 10*b*-11*b* respectively) or, vice versa, downward, i.e. in the position releasing the firearm 11, assembly created by body 22, said first and second hemi-worms 24 and 25, so as to permit to the body 22 head 22' engaging with said motion transfer lever 18 offset 23, or to disengage from the same.

Obviously, it is possible by said actuator means 10 blocking every projection, transmission, lever or pin connected with the trigger 13 (or every other member connected with the same trigger) or every other percussion member 16 or cane or transmission of the motion to the cane-teeth group or kinematic part for transmitting the motion. Particularly, it is known that most of long firearms exploits a triggering mechanism having a trigger acting directly on a percussion pin check tooth. In this cases (for example rifles), actuator means carrying out a blocking action can be directly connected with trigger, either to the triggering lever or percussion pin check tooth. For example, in Mauser system and like, the percussion pin check tooth is surely the best example of support element for actuator means 10.

Finally, FIGS. 12*a* and 12*b* and 13*a* and 13*b* show a further embodiment of said actuator means with reference to the coupling between said worm screw 21 and said body 22. Particularly, it is observed a further body 21', keyed on said shaft 20, said further body is provided with a peripheral helicoidal groove 21" engaged with a pin 22". Said pin 22" projects from the inner surface of said body 22.

Figure 13A:
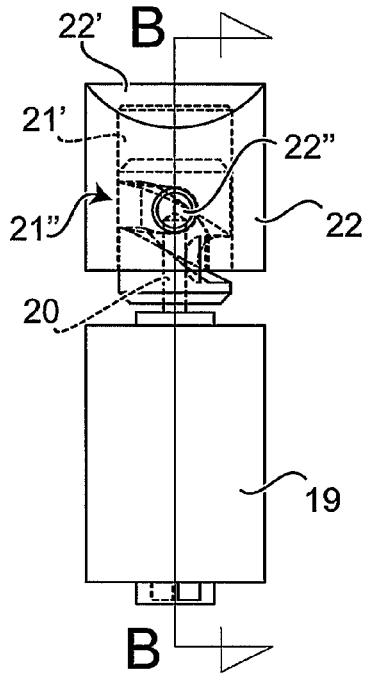
FIG. 13*a* shows a transparency longitudinal view of actuator means in an active position.
Figure 13B:
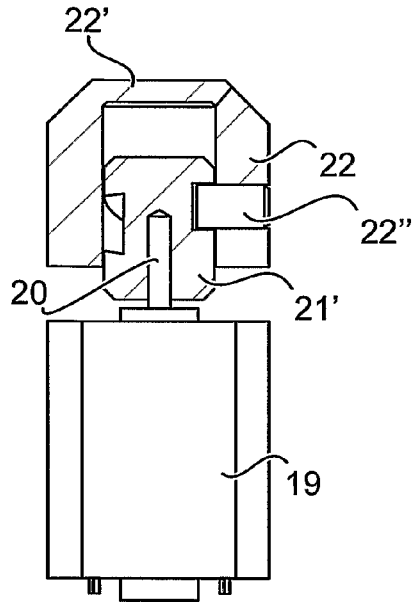
FIG. 13*b* shows a longitudinal section view of actuator means in an active position taken along plane A-A of FIG. 12*a;*
Figure 12A:
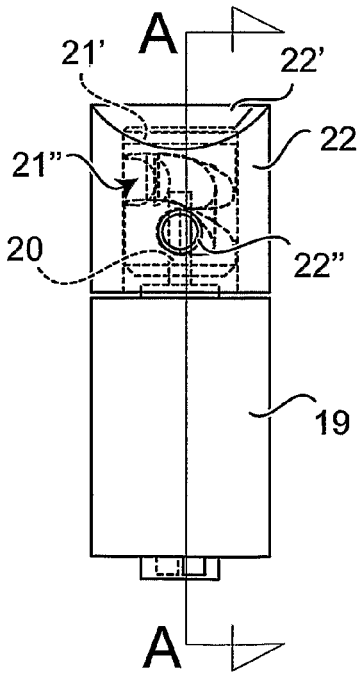
FIG. 12*a* shows a transparency longitudinal view of actuator means in a rest position.
Figure 12B:
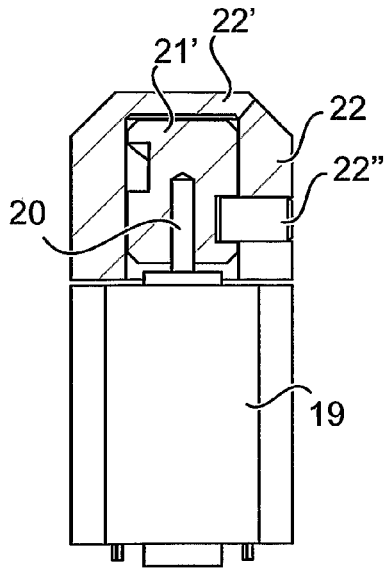
FIG. 12*b* shows a longitudinal section view of actuator means in a rest position taken along plane A-A of FIG. 12*a;*

FIGS. 12*a* and 12*b* show body 22 in a resting position (firearm 11 released), while FIGS. 13*a* and 13*b* show body 22 in an active position (firearm 11 blocked).

Rotation of said further body 21' upward, i.e. in the firearm blocking position, or vice versa, downward, i.e. in the firearm releasing position, assembly comprised of body 22 and said further body 21', so as to permit to the body 22 head 22' engaging or disengaging with motion transfer lever 18 offset 23.

It must be observed that device 1 according to the present invention can be applied to every kind of firearm.

Safety device 1 according to the invention permits implementing a centralised remote control system for one or more firearms 11.

Particularly, said system is comprised by a data control and transmission through two different electronic control systems, connected each other by a biunivocal complete safety protocol, preferably using a blue tooth transmission protocol.

Figure 14:
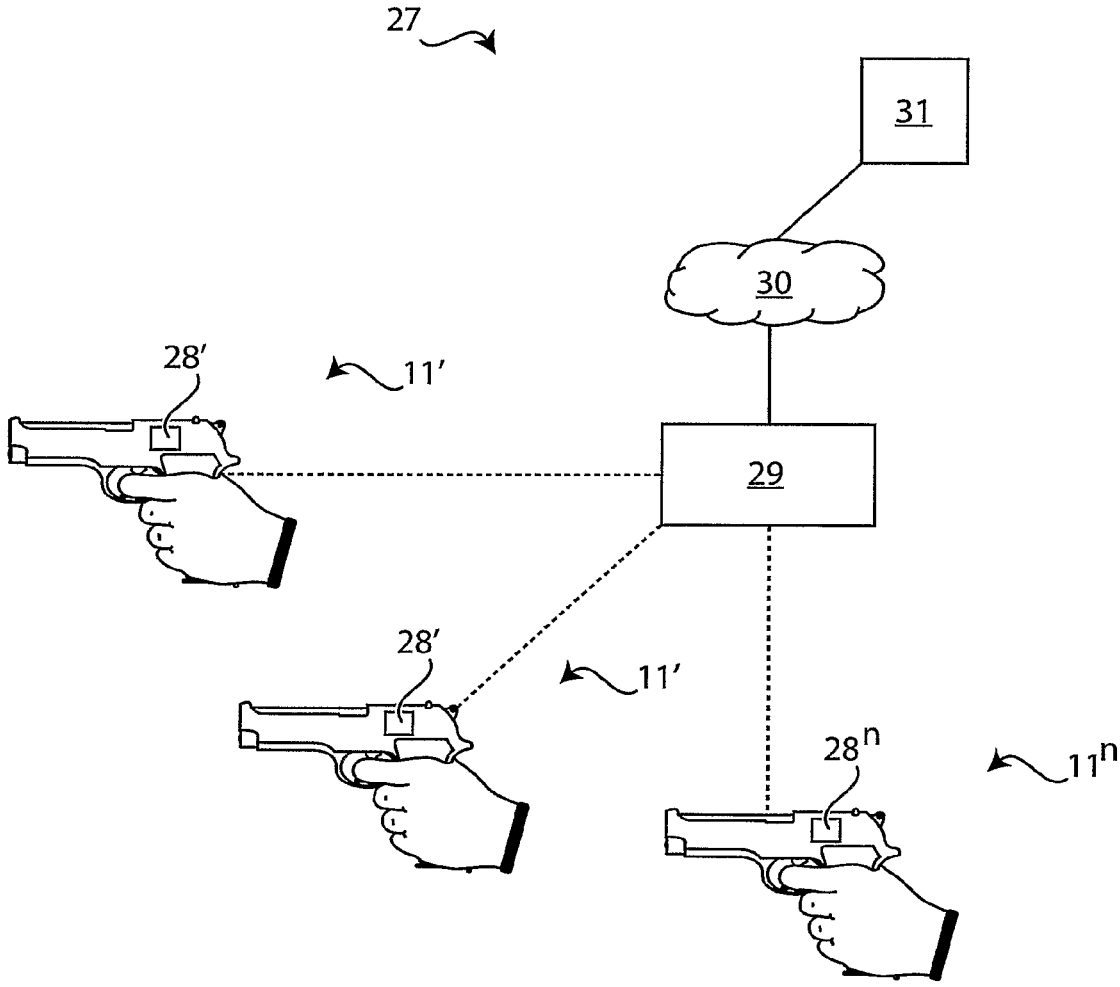
FIG. 14 is a block diagram of a control system for one or more firearms according to the invention.

In other words, making reference to FIG. 14, it is noted that above system 27 provides, for a plurality of firearms 11', 11", . . . , 11$^n$, a local transceiving unit 28', 28", . . . , 28$^n$, and a "bridge" control apparatus 29, that will be described in the following.

Said local transceiving unit 28 is substantially a blue tooth board, integrated and miniaturised in each firearm 11', 11", . . . , 11$^n$. Each local transceiving unit 28', 28", . . . , 28$^n$ is connected with the main circuit controlling the electro mechanic firearm blocking function, i.e. with said actuator means with which shares the supply to the battery 6.

Said local transceiving units 28', 28", . . . , 28$^n$ can be placed in different points in the corresponding firearm 11', 11", . . . , 11$^n$, for example:

in the part under the barrel of a semiautomatic gun 11', 11", . . . , 11$^n$ body; or in the wood or plastic handle of a long firearm.

Each one of said local transceiving units 28', 28", . . . , 28$^n$ will be set to transmit and to interface, preferably under a protected mode, with said control apparatus 29, apt to receive and transmit data through a local UMTS network 30 to a directional centre 31. Contents exchanged between each one of said local transceiving units 28', 28", . . . , 28$^n$ and said control apparatus 29 are data relevant to the use of each firearm under control, and more particularly:

time, date and control circuit switching on/switching off cell, time, date and cell of every single shooting of the firearm;

time, date and cell of every tampering/disconnection of the control circuit.

Cell concerns localisation on the territory for every event mentioned in the above through the GPRS-UMTS radio bridges network 30.

Said control apparatus 30 is substantially a small portable apparatus, very similar to a last generation phone, provided with an auto fed colour display. Said control apparatus 30 is always and at the same time connected with each one of said local transceiving units 28', 28", 28$^n$ of each controlled firearm 11', 11", . . . , 11$^n$ and to the UMTS 30 network (in case after suitable agreement with the handler).

In order to avoid interferences, juxtapositions or data reception—theft by other apparatuses suitable to receive blue tooth data, said control apparatus supports/accepts interface only of the authorised local transceiving units 28', 28", . . . , 28$^n$ of each controlled firearm 11', 11", . . . , 11$^n$.

Furthermore, it is necessary establishing a connection protocol with complex crossed codes authorisation between local transceiving units 28', 28", . . . , 28$^n$ and control apparatus 30, so as to obtain the following functionalities:

(a) in presence of a switched off control apparatus, firearm switches on but, not finding immediate exchange with said control apparatus 29, does not permit reading of authorised transponder 5, and thus possibility of shooting;

(b) in presence of a switched on but not authorised control apparatus 29, as in previous point (a), does not permit reading of authorised transponder 5 and thus does not permit shooting;

(c) every time the control apparatus goes out of the useful transmission field of a transceiving unit 28, the latter stops transponder 5 reading as soon as it can, denying authorisation to shoot (for example in case of control apparatus 29 theft);

(d) in case data transmission field from dedicated UMTS network 30 is absent (e.g. in case firearm is stored in wine cellars, galleries, insulated rooms, etc,) authorisation between said firearm 11 and the control apparatus 30 remains for the necessary period, ensuring functionality of the system 27. Therefore, control apparatus 29 stores data relevant to the use of the firearm 11, transmitting them to the network 30 as soon as the field exists again. Even if the field is still absent (e.g. intentional removal of battery), data are in any case still available to Police controlling the direction centre 31.

Finally, it must be taken into consideration that private data of purchaser, residence of the purchaser, firearm registration number, caliber, purchase date, number of gun license, and other interesting data (e.g. those relevant to a police team, an army division, ecc.) will be stored by the manufacturers (when the firearm is sold, by a transmitter electronic recorder and not by a mechanical connection with the base printed by a gate) for each firearm 11', 11", . . . , 11$^n$.

After reception of a simple code data message (even not encrypted SMS, being not possible disassembling or tampering the electronic system in any case) it is possible remote blocking one of the firearm 11', 11", . . . , 11$^n$.

Said control apparatus 29 can further comprise a data chip set to disconnect supply. Blocking message arriving from directional centre 31 through the radio bridge 30 will wait on the same bridge 30 (even in case of roaming abroad) until when firearm 11', 11", . . . , 11$^n$ will appear "in the "network" that can be controlled by control apparatus 29.

In other words, in case one of firearms 11', 11", . . . , 11$^n$ is intentionally shielded, blocking message continues to be present on the radio bridge 30, as a standard SMS, and it is automatically and continuously transmitted to the control apparatus 29 until when the latter ensures by a response message that it has been realised the block of the firearm, as soon as the local transceiving unit 28 of the corresponding firearm 11 is again in the network.

Above system 27 sends a confirmation message of the block to the directional centre 31 responding to the chip-system of the apparatus control 29. Said message can also be sent from a standard portable phone or Computer to the local transceiving unit 28 of the corresponding firearm 11, even by the owner, by a secret code, in order to timely deactivating the firearm 11 in case it has been theft or lost.

Data transmission can also be initialised again by Police, operating again the system 27, and memorised again by the manufacturer (by the transmitter—port less recording system), that will occur only after the authorisation obtained by suitable documents issued by Public Authority (for civil use) and Military Command for military use and Law Enforcement.

It is evident that data transmission and control functionality, connected with that blocking—releasing firearms 11', 11", . . . , 11$^n$ occurs by sending by radio a code string, thus giving many possibilities for controlling the single firearm or groups of firearms.

Particularly, besides being possible blocking the firearm by the same owner, it has a large social benefit that permitting to a central, regional or peripheral control organisation to be able to "switch off" and to "authorise" the use of a single firearm, of the firearms of a single community (condominium, small town, city) or of a nation.

Furthermore, it is very interesting the functionality of a remote electronic control of clever firearms of one or more categories (for example short arms, semiautomatic firearms, or firearms divided on the basis of their caliber) or for a division (barracks, platoon, regiment captured by enemies, ecc.). It could be finally very interesting for controlling the territory during the hunting period, thus controlling hunting time and so on, applying the data transmission system for preventing poachers from hunting, not permitted use and transportation of firearms, undisputable responsibility of a single person in case of hunting accident.

An advantage of the present invention is the way by which the code transponder and micro controller integrated circuit can be given to the Police permitting a control both of firearm and of the users.

A further advantage of the present invention is the possibility of miniaturising components of said safety device, permitting its implementation in existing firearms and easy installation in firearm to be manufactured.

Another advantage of the present invention is the fact that said firearm safety device can be applied to every kind of firearm, either a commercial firearm or a military firearm.

A further advantage of the present invention is that said safety device can be installed in every firearm, such as short, long, automatic, or semiautomatic firearms.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A safety device (1) for a firearm (11), comprising:

actuator means (10,10',19, 20, 21, 21', 22), suitable to engage with mechanical parts of said firearm (11) so as to alternately prevent or permit operation of said firearm; and a control unit (2), operatively connected with said actuator means (10,10',19, 20, 21, 21', 22), said control unit (2) comprising transceiving means (3) configured to exchange signals with certification outer means of an authorised user (U) for codified remote control of said actuator means (10,10',19, 20, 21, 21', 22), wherein said actuator means comprises i) an electric motor (19) having a shaft (20) operatively coupled with said control unit (2), ii) a body (22) slidable within said firearm (11) and engageable with said mechanical parts of said firearm (11), and iii) means for transforming a rotary motion of said motor (19) into a translation motion of said body (22), the transforming means coupled with said motor (19) and said body (22), an activation of said electric motor (19) enabling a translatory motion of said body (22) to enable said body (22) to alternately engage or disengage from said mechanical parts of said firearm (11) in order to alternately prevent or permit operation of said firearm, and wherein said motion transformation means comprise i) a worm screw (21) keyed on said shaft (20), ii) a worm comprising a first and a second half-worm screws (24, 25) housed within a cavity (22") obtained within said body (22), said first and second half-worm screws (24, 25) being adjacent each other and a threaded channel being realized between them, within which said worm screw (21) is inserted, and iii) resilient means (26) between the inner wall of said body (22) and said second half-worm screw (25), suitable to permit compensation of tolerances and a safe coupling of said worm screw (21) within said threaded channel realized between said first and second half-worm screws (24, 25).

2. The safety device (1) according to claim 1, wherein said transceiving means (3) comprise electromagnetic transceiving means (4, 8) and said certification means cooperating with the same comprise a transponder (5), said transponder (5) being brought by the authorised user (U).

3. The safety device (1) according to claim 2, wherein said electromagnetic transceiving means comprise a turn (4) and a modulation/demodulation radio frequency unit (8).

4. The safety device (1) according to claim 2, wherein said transponder (5) is a passive transponder.

5. The safety device (1) according to claim 2, wherein said transponder (5) comprises an integrated circuit, storing an identification code.

6. The safety device (1) according to claim 2, wherein said transponder (5) is provided in a bracelet wearable by said authorised user (U).

7. The safety device (1) according to claim 2, wherein said transponder (5) is provided in a ring wearable by said authorised user (U).

8. The safety device (1) according to claim 2, wherein said transponder (5) is configured to be provided under the skin of said authorised user (U).

9. The safety device (1) according to claim 1, wherein said transceiving means (3) comprise a voice recognition device, said voice recognition device configured to activate said actuator means (10; 10'; 19, 20, 21, 21', 22) by a voice control and to deactivate said actuator means by one of a second voice control and expiration of a set time period.

10. The safety device (1) according to claim 1, wherein said control unit (2) comprises a processing unit (7) connected to a power circuit for piloting of said actuator means (10; 10'; 19, 20, 21, 21', 22).

11. The safety device (1) according to claim 10, wherein said processing unit (7) comprises a micro controller.

12. The safety device (1) according to claim 1, wherein said mechanical parts correspond to parts for transmitting kinematic motion between a trigger (13) and a percussion member (16) of said firearm (11), the parts comprising a lever (18) to transmit the kinematic motion the lever pivoted on the trigger (13) and having an offset (23), said body (22) having a head (22') engaged in said offset (23) of said lever (18) to transmit the kinematic motion.

13. The safety device (1) according to claim 1, wherein said means for transformation of the motion comprise a worm screw (21), keyed on said shaft (20), and a threaded channel in said body (22) and engageable with said worm screw (21).

14. The safety device (1) according to claim 1, wherein said resilient means are a spring.

15. The safety device (1) according to claim 1, wherein said motion transformation means comprise a further body (21') keyed on said shaft (22), provided with a peripheral helicoidal groove (21"), and a pin (22") projecting with respect to the inner surface of said body (22), engageable with said helicoidal groove (21") of said further body (21').

16. The safety device (1) according to claim 1, wherein said actuator means (10; 10'; 19, 20, 21, 21', 22) are housed in the part under a trigger (13) of the firearm such that stresses on the trigger (13) are not transmitted to the movable parts and said motor (19).

17. The safety device (1) according to claim 1, wherein said actuator means comprise an electromagnetic lock bolt (10'), said electromagnetic lock bolt (10') being comprised of a lock bolt and an inductor.

18. The safety device (1) according to claim 17, wherein said lock bolt (10') engages within a cavity (14) obtained on the trigger of said firearm (11).

19. The safety device (1) according to claim 1, wherein it comprises energy supply means.

20. The safety device (1) according to claim 19, wherein said energy supply means is a lithium battery.

21. The safety device (1) according to claim 19, wherein said energy supply means comprises a battery (6) with high efficiency cells.

22. The safety device (1) according to claim 19, wherein said energy supply means comprise a first battery (6) and a second battery operable after a discharge of said first battery (6).

23. The safety device (1) according to claim 19, wherein said energy supply means comprise a holster provided with a first battery (6) and a second battery that connectable with said first battery (6) by electric contacts in order to recharge the first battery (6) when said firearm (11) is placed within said holster.

24. The safety device (1) according to claim 19, wherein said energy supply means is electrically connected with said control unit (2) by a switch, said switch configured to close when said firearm is grasped.

25. A remote control system for one or more firearms (11', 11", . . . , 11$^n$) each comprising a safety device (1', 1", . . . , 1$^n$) as claimed in claim 1, said system (27) comprising:

one or more local transceiving units (28', 28", . . . , 28$^n$), each local transceiving unit provided on one of said one or more firearms (11', 11", . . . , 11$^n$) and connected with the safety device (1', 1", . . . , 1$^n$) of the firearm; and a control apparatus (29) comprising first transceiving means suitable to interface with said local transceiving units (28', 28", . . . , 28$^n$), said control apparatus (29) being suitable to alternately inhibit or enabling operation of each firearm (11', 11", . . . , 11$^n$) by way of said local transceiving unit (28', 28", . . . , 28$^n$) and said safety devices (1', 1", . . . , 1$^n$).

26. The system according to claim 25, wherein said control apparatus (29) comprises i) second transceiving means suitable to interface with a data transmission network (30), and a directional centre (31) that connectable with said control apparatus (29), said directional centre (31) being suitable to alternately inhibit or enable operation of each firearm (11', 11", . . . , 11$^n$) by transmission of controls sent to said control apparatus (29).

27. The system according to claim 26, wherein said data transmission network is either of a GPRS and a UMTS network.

28. The system according to claim 25, wherein said one or more local transceiving units (28', 28", . . . , 28$^n$) are connected with said power supply means of said safety device (1', 1", . . . , 1$^n$) of each firearm (11', 11", . . . , 11$^n$).

29. The system according to claim 25, wherein said local transceiving unit (28', 28", . . . , 28$^n$) and said first transceiving means of said control apparatus (29) use Bluetooth wireless protocol.

30. The system according to claim 25, wherein connection between each local transceiving unit (28', 28", . . . , 28$^n$) and said control apparatus (29) is protected.

* * * * *